US010077755B2

(12) United States Patent
Akbayir

(10) Patent No.: US 10,077,755 B2
(45) Date of Patent: Sep. 18, 2018

(54) METHOD AND DEVICE FOR PRODUCING A DRIVING FORCE BY BRINGING ABOUT DIFFERENCES IN A CLOSED GAS/LIQUID SYSTEM

(76) Inventor: Zeki Akbayir, Beerfelden-Hetzbach (DE)

( * ) Notice: Subject to any disclaimer, the term of this patent is extended or adjusted under 35 U.S.C. 154(b) by 1190 days.

(21) Appl. No.: 14/126,017

(22) PCT Filed: Jun. 11, 2012

(86) PCT No.: PCT/EP2012/002458

§ 371 (c)(1),
(2), (4) Date: Jan. 31, 2014

(87) PCT Pub. No.: WO2012/171628

PCT Pub. Date: Dec. 20, 2012

(65) Prior Publication Data

US 2014/0133961 A1 May 15, 2014

(30) Foreign Application Priority Data

Jun. 16, 2011 (EP) ..... 11004923

(51) Int. Cl.
*F03B 3/00* (2006.01)
*F03B 17/00* (2006.01)

(52) U.S. Cl.
CPC ..... *F03B 3/00* (2013.01); *F03B 17/00* (2013.01); *F03B 17/005* (2013.01)

(58) Field of Classification Search
CPC ..... F03B 3/00; F03B 17/00; F03B 17/005
See application file for complete search history.

(56) References Cited

U.S. PATENT DOCUMENTS

| | | | | |
|---|---|---|---|---|
| 7,533,525 | B2 | 5/2009 | Brees | |
| 2003/0146627 | A1* | 8/2003 | Parviainen | F03B 3/00 290/54 |
| 2009/0022585 | A1 | 1/2009 | Akbayir | |

FOREIGN PATENT DOCUMENTS

| | | |
|---|---|---|
| DE | 37 20 580 | 1/1989 |
| DE | 196 44 670 | 7/1997 |
| DE | 196 47 476 | 5/1998 |
| DE | 101 33 547 | 10/2002 |
| DE | 10 2006 023 017 | 12/2006 |
| DE | 10 2005 049 938 | 3/2007 |

* cited by examiner

*Primary Examiner* — Woody Lee, Jr.
*Assistant Examiner* — Maxime Adjagbe
(74) *Attorney, Agent, or Firm* — Colard & Roe, P.C.

(57) ABSTRACT

The invention relates to a method for producing a continuous driving force by providing kinetic energy of a liquid medium by means of bringing about differences in pressure in a closed system that is filled with liquid medium, in particular water, and gaseous medium, in particular air, and relates to a device for implementing the method, wherein the device consists of a vessel (1), which is enclosed on all sides, in which there is inserted an insert (2) that is open on its underside and in which a hollow body (3) with an outlet opening (4) is arranged on the upper side of the insert (2). Within the insert (2), a rotor (8) is arranged on a vertical shaft (7), said rotor (8) being driven by a motor (9). Fitted in the vessel (1) outside the insert (2) are one or more riser pipes (10), which are open at their lower ends and are inserted with their upper ends in the hollow body (3) above the insert (2) in a sealed-off manner.

12 Claims, 12 Drawing Sheets

24

Figure 1:
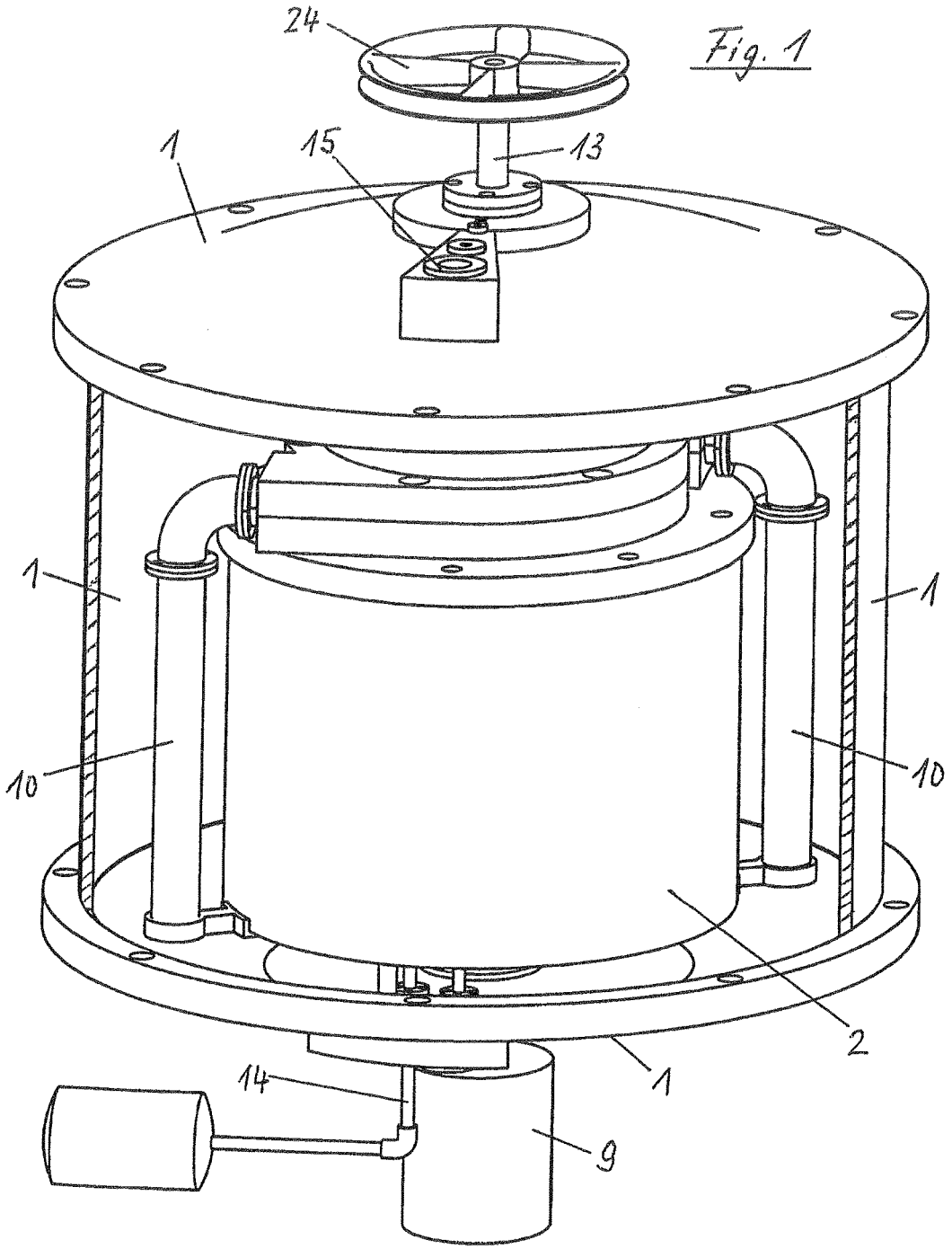

1
15
13
1
1
10
10
2
1
14
9

24
15
13
1
3
12
22
19
A
A
5
23
1
1
27
10
10
21
20
27
16
2
2
21
27
7
18
17
8
14
9

24
15
1
3
13
12
19
11
4
2
5
23
1
5
23
27
8
6
20
2
7
27
14
1
9

METHOD AND DEVICE FOR PRODUCING A DRIVING FORCE BY BRINGING ABOUT DIFFERENCES IN A CLOSED GAS/LIQUID SYSTEM

CROSS-REFERENCE TO A RELATED APPLICATION

The invention described and claimed hereinbelow is also described in the European Patent Application 11004923.6 filed on Jun. 16, 2011. This European Patent Application, whose subject matter is incorporated here by reference, provides the basis for a claim of priority of invention under 35 U.S.C. 119 (a)-(d).

The invention relates to a method for producing a continuous driving force by providing kinetic energy of a liquid by bringing about differences in pressure in a closed gas/liquid system, in particular in an air/water system, and to a device for implementing the method.

Machines are known that can convert available kinetic energy of a liquid into power in the form of a rotating shaft. These are generally referred to as turbo engines. Very high power output combined with good efficiency can be achieved by such machines using water as the working fluid, in particular Pelton turbines (e.g. patent DE 10133547A1) for water under high pressure and a having relatively low flow rate. This type of turbine is also referred to as a constant-pressure turbine, since the energy is converted in the impeller under constant atmospheric pressure. In the technical application, these turbines are typically used in hydroelectric power plants having great available potential heads. The usability of this type of turbine is therefore limited to geographical regions that offer very great differences in height along a short distance. In addition, water from the natural cycle, preferably from dam lakes at high altitudes, is usually used as the working medium. The energy production is therefore not unlimited, nor is it permanent.

Turbo working machines are also known. Such machines basically produce an increase in the pressure or enthalpy of the working fluid while providing mechanical work in the form of a rotating shaft. Pumps or reciprocating piston compressors are used in technology in order to increase the pressure of water as the working fluid. In both configurations, energy is transferred directly to water, as the working medium. If the pump, as the turbo working machine, is combined with the radial turbine, as the turbo engine, both of which are operated in a closed circuit with water as the working fluid, one arrives at the technical application of the hydrodynamic converter (e.g. patent DE 102006023017A1). This hydrodynamic converter converts the torque and rotational speed of the two shafts and outputs less output power than input power, due to the frictional losses and the increase in entropy in the system.

Profiles around which flow occurs, which are used to produce pressure differentials, are also known in many technical applications. In turbomachines, through which flow usually occurs axially, these profiles are used as part of the impeller or, in the case of aviation applications, as an airfoil profile. The task of these profiles is always that of producing a force that is intended to act perpendicularly to the main direction of the flow—of a liquid that is usually compressible—extending along the profile. As a result, in aviation applications, for example, lift is produced and torque is produced on the shaft at the vanes of axial gas turbine rotors.

The problem addressed by the invention is that of creating—by means of a suitable combination of various above-described and further technical modes of operation and the targeted application thereof with compressible and incompressible media—a method for providing continuous kinetic energy and of creating a device for the implementation and application of the method for the purpose of providing continuous power output.

This problem is substantially solved by means of a method and a device for generating a continuous driving force by providing kinetic energy of a liquid medium generated by bringing about differences in pressure in a closed system which is filled with the liquid medium and a gaseous medium. The device has a vessel which is closed on all sides and having a closeable opening for filling the vessel with the liquid medium, an insert inserted into the vessel, the insert being open on an underside thereof, and a spherical hollow body having an outlet opening and an attachment, the spherical hollow body being located on a top side of the insert and being disposed entirely or partially within the vessel and extending into the insert by a portion of a height thereof. The hollow body is pressure-sealed both with respect to the vessel and with respect to the insert, except for the outlet opening. There is a rotor disposed within the insert and having a separation from an inner wall of the insert. The rotor is formed as a cylindrical disk on a vertical shaft in a shaft housing so as to be rotatable and pressure-sealed. An attachment is provided, via which the rotor extends, in a rotatable and sealed manner, without a fixed connection, into the outlet opening of the hollow body via the attachment of the hollow body, the rotor extending over said outlet opening over a portion of the height thereof. The rotor including the attachment comprises one or more tubular channels, which are open at ends thereof and extend from an upper end of the attachment of the rotor through an inner region of the rotor to an outer circumference thereof and terminate in outlet openings of the rotor. A jacket surface of the rotor is provided with one or multiple wing profile units which are disposed with periodic spacing from each other and each consist, in a direction of rotation of the rotor, of a convex raised area followed by a flat runout region having the outlet openings of the rotor. There is also a motor configured for driving the rotor, one or more ascending pipes mounted in the vessel outside the insert, the pipes being open at lower ends thereof and extending vertically downwardly at least to a lower edge of the insert and being inserted, via upper ends thereof, into the hollow body in a sealed manner via bends above the insert and terminating horizontally within the hollow body, and a feed pipe for compressed air being routed from outside the vessel into the insert and leading into the insert, above an upper edge thereof.

Figure 2:
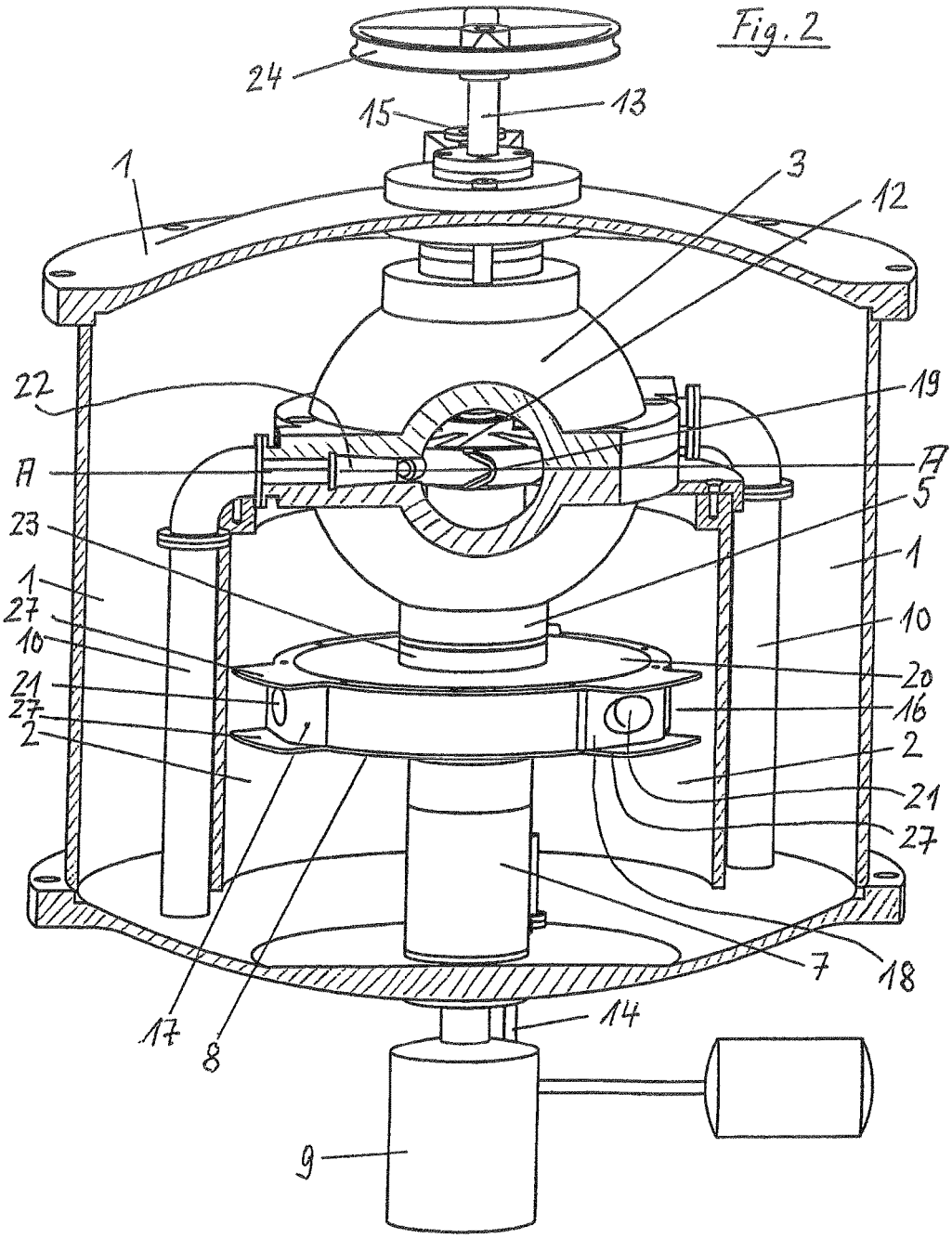
Figure 3:
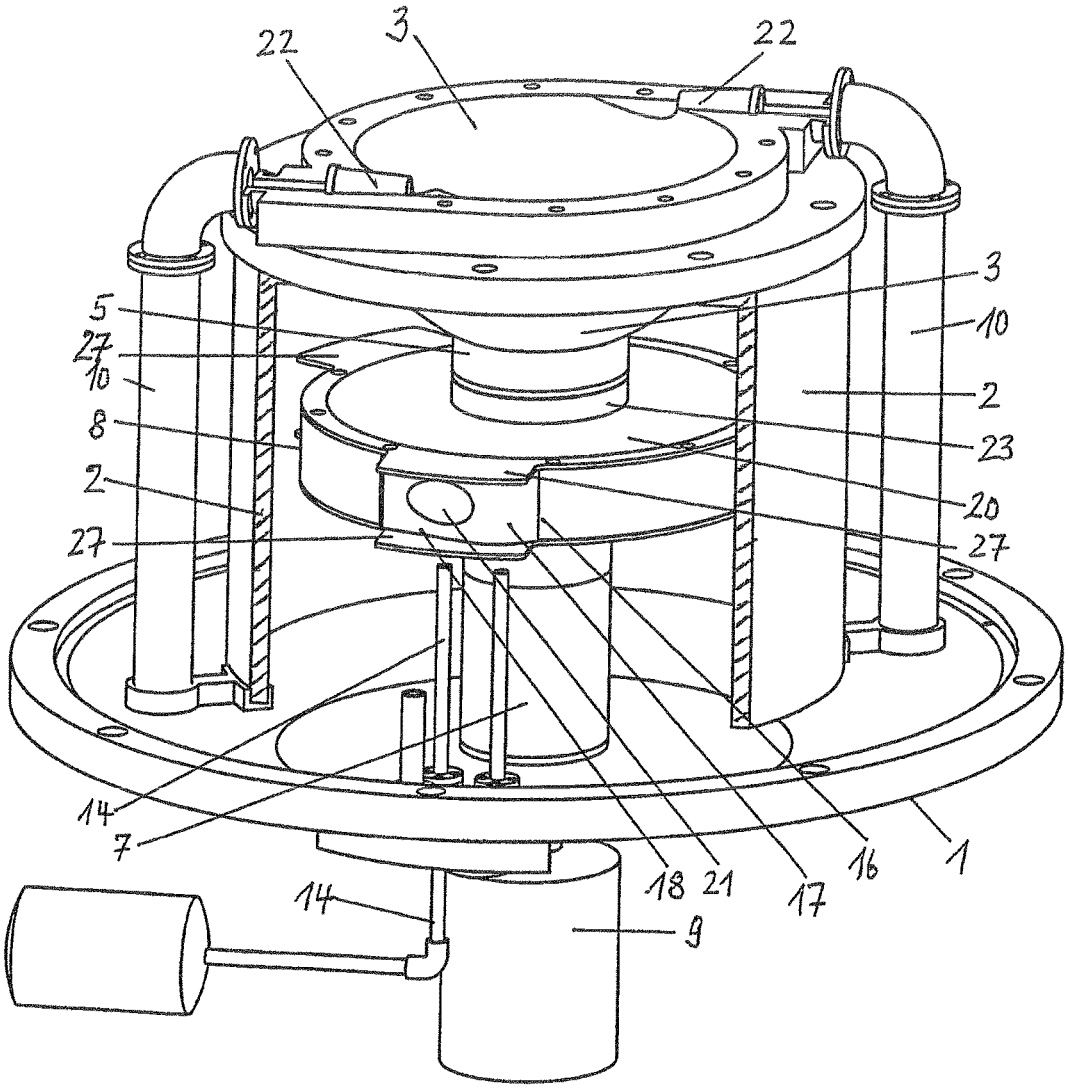
Figure 4:
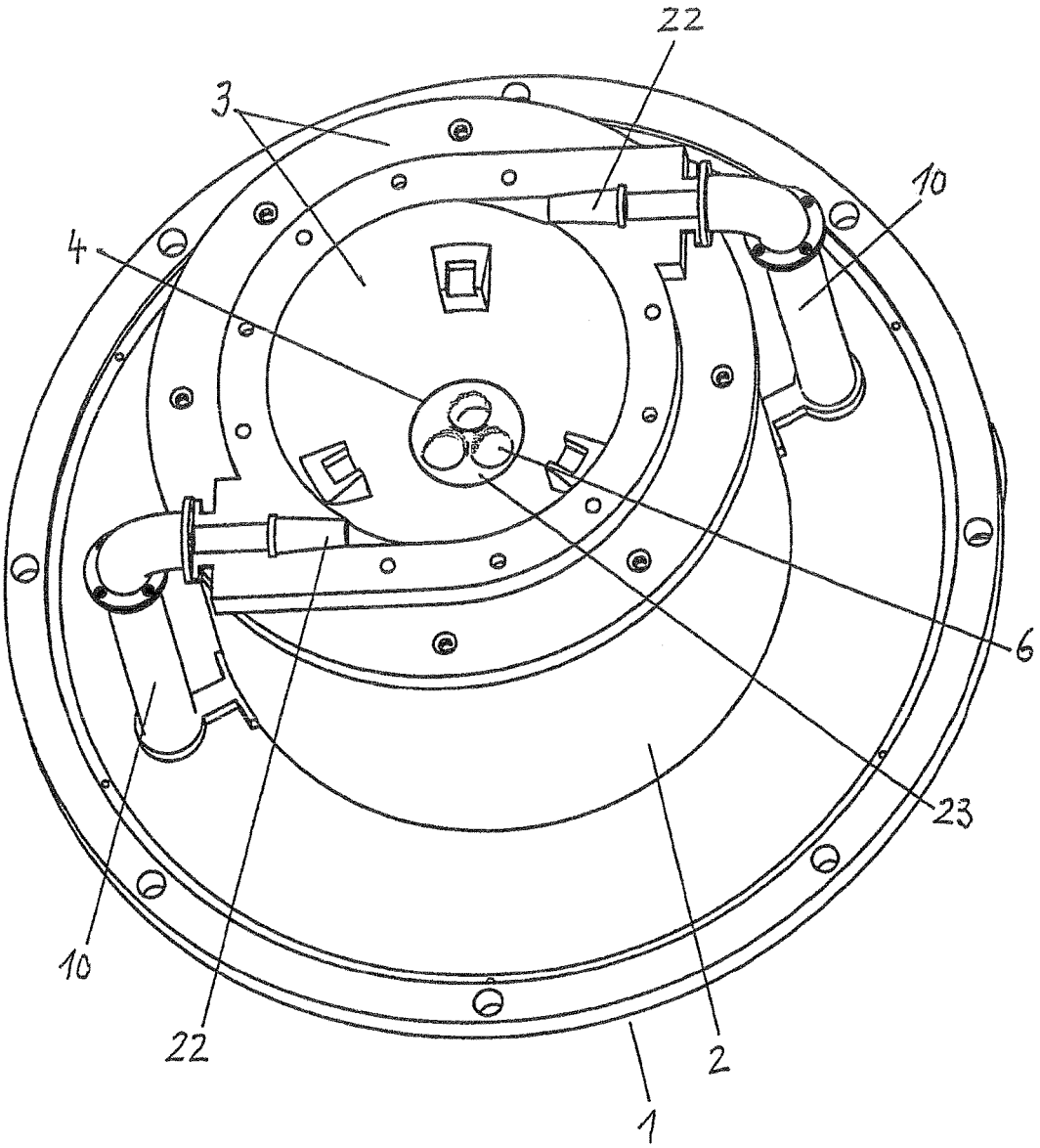
Figure 5:
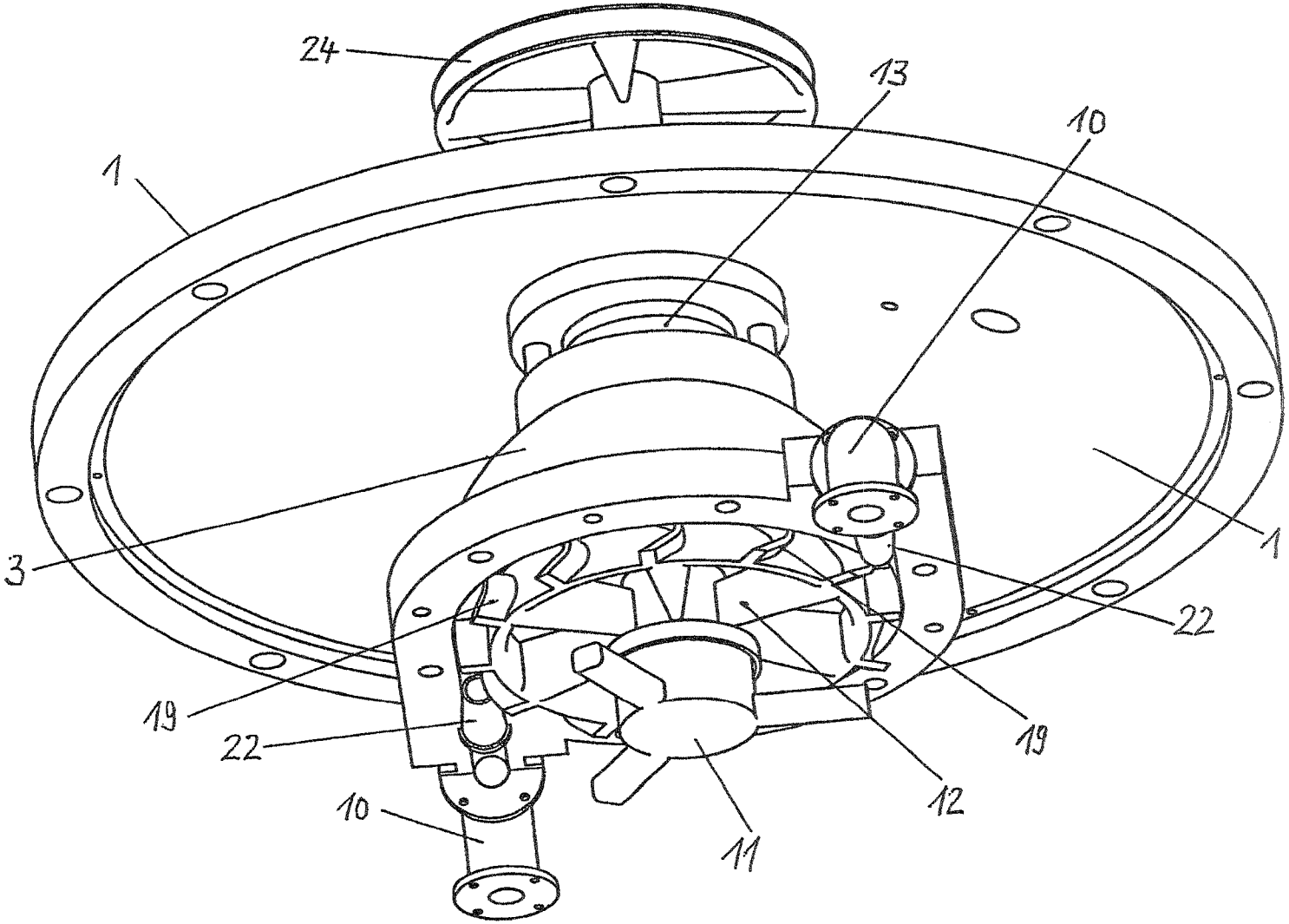
Figure 6:
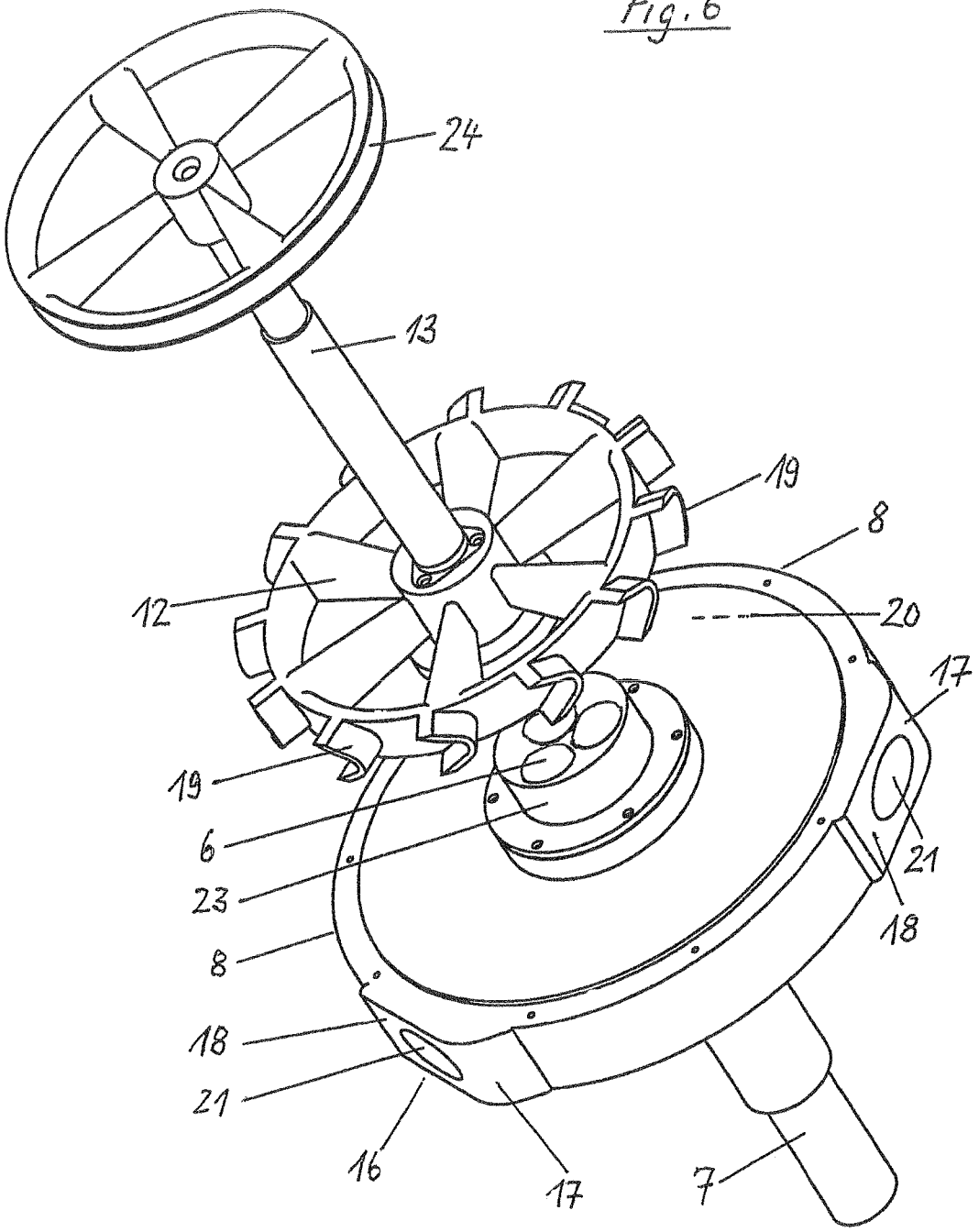
Figure 7:
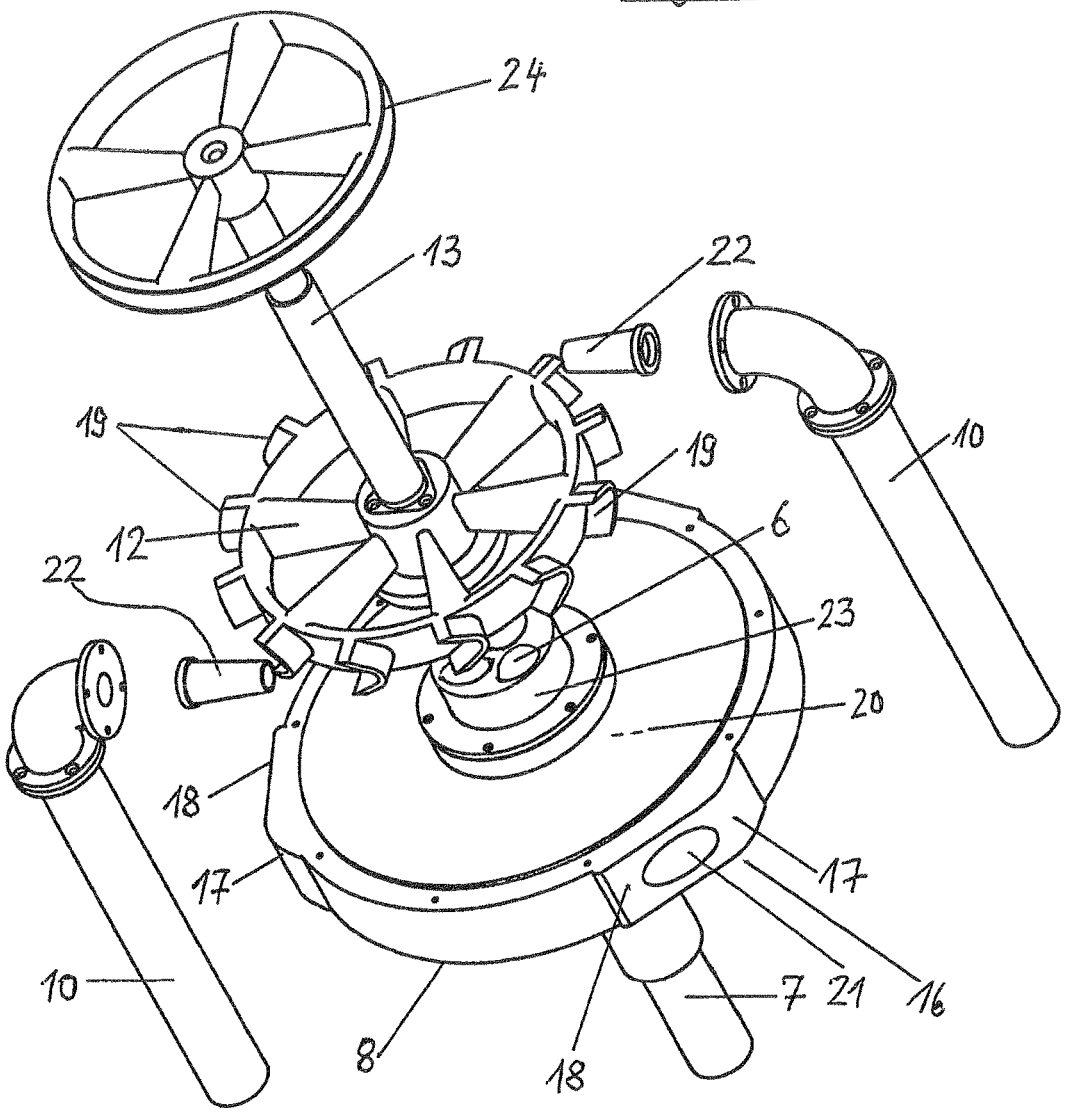
Figure 8:
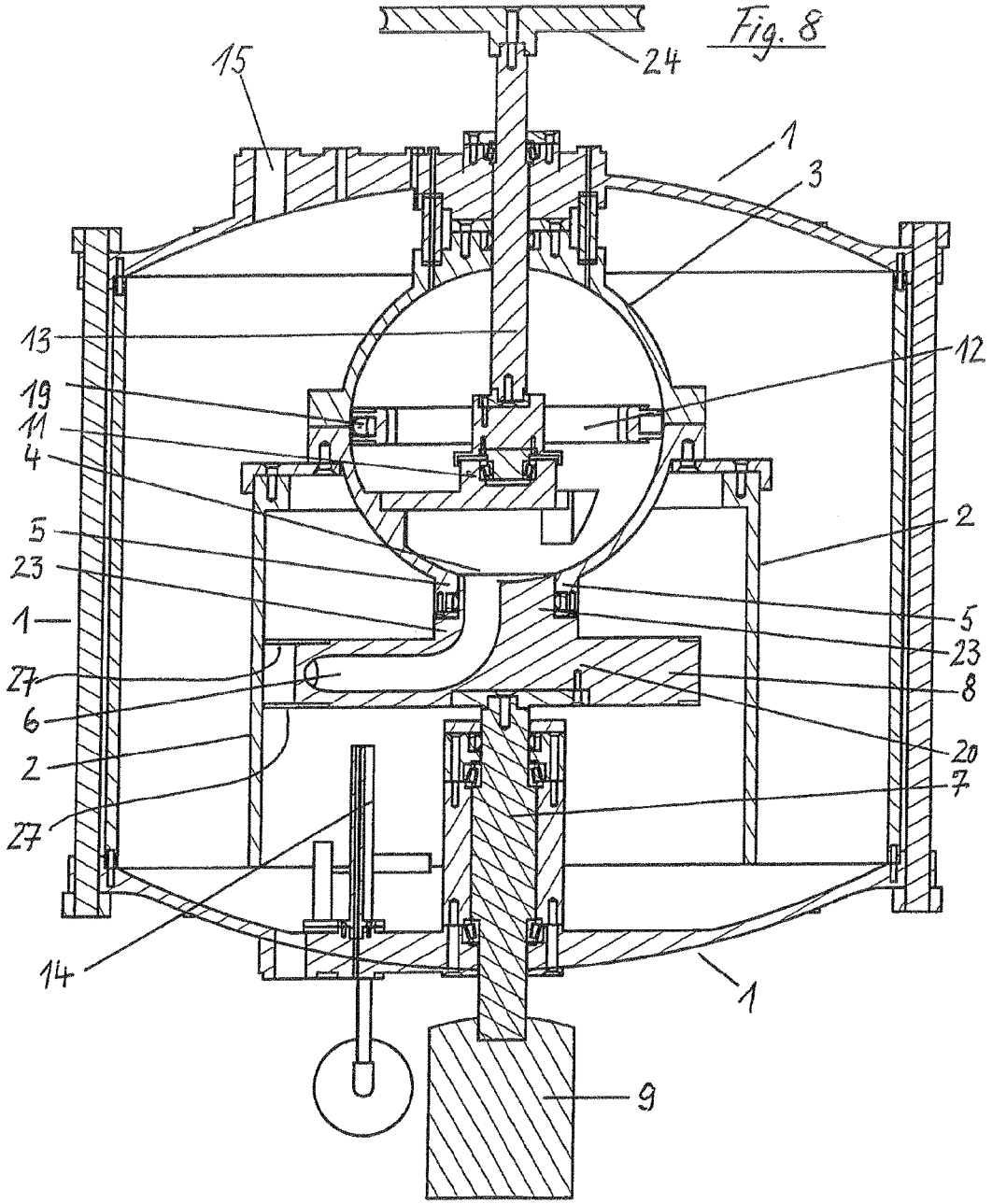
Figure 9:
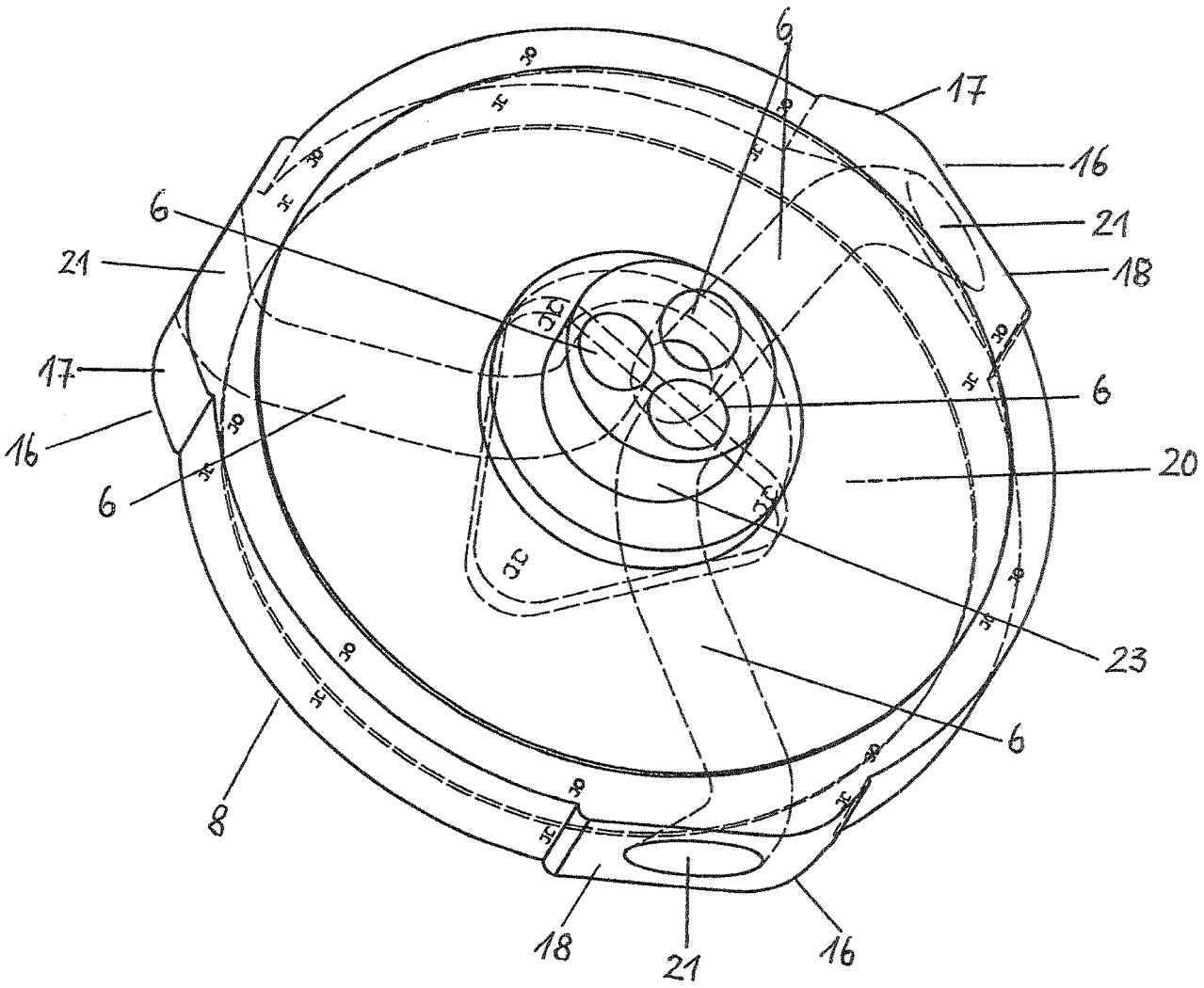
Figure 10:
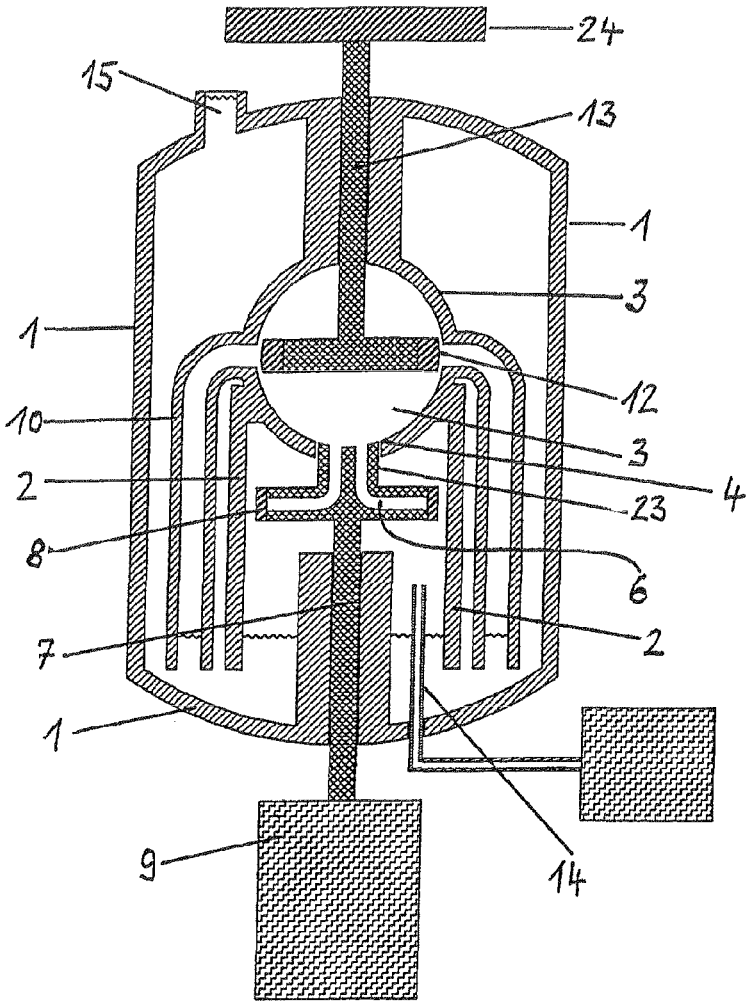
Figure 11:
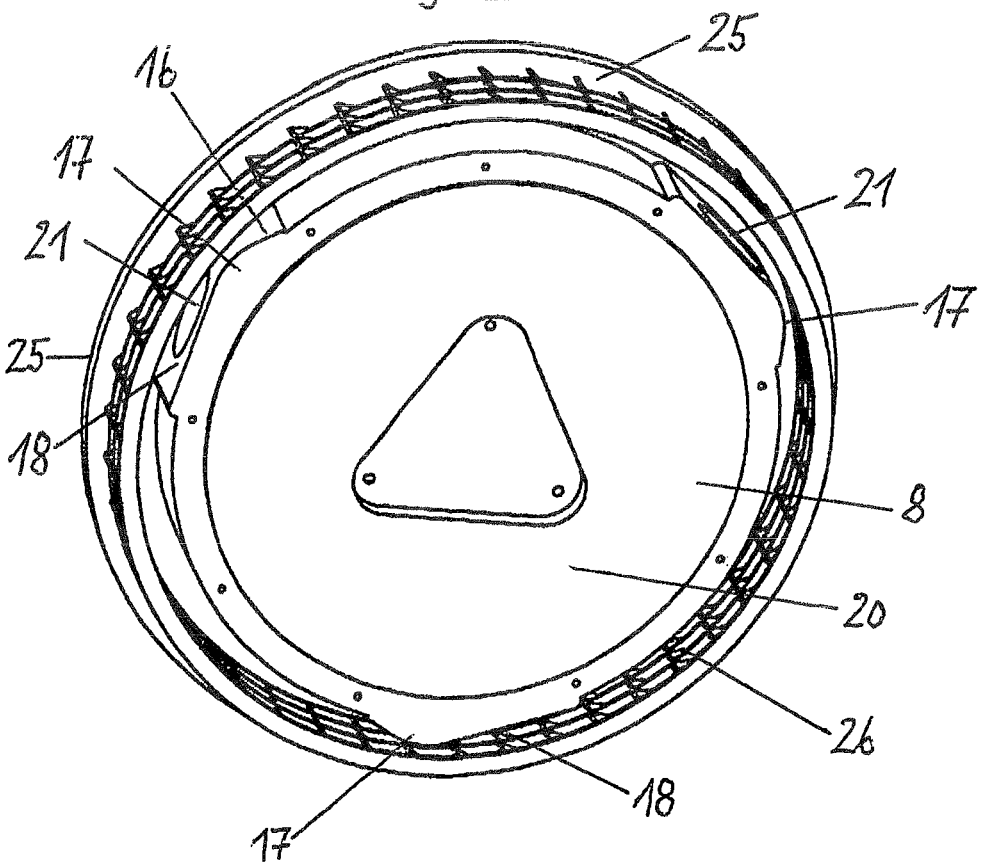
Figure 12:
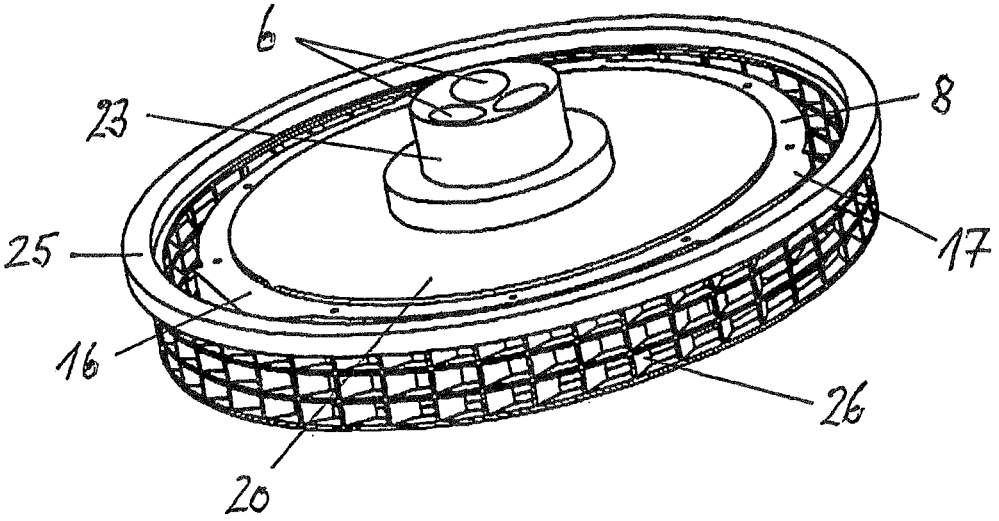
Figure 13:
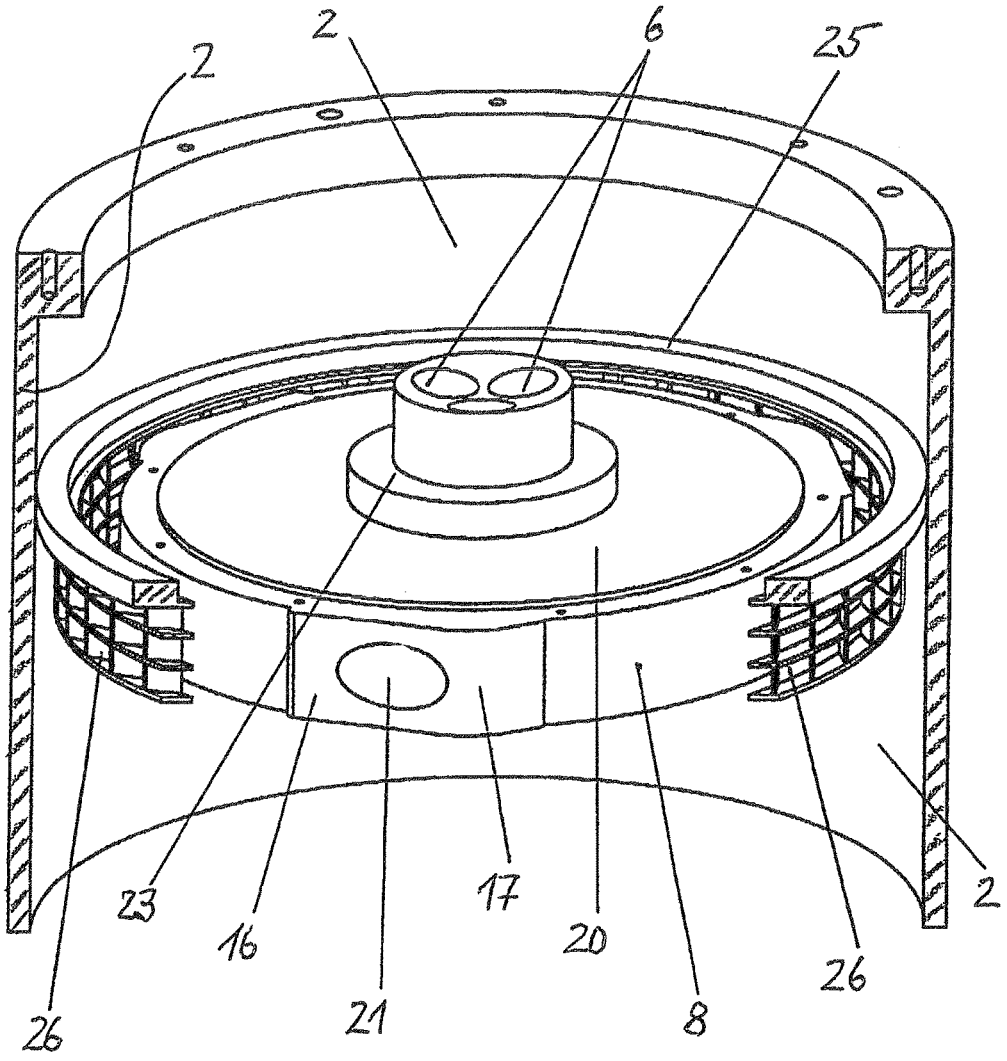

The method according to the invention and a device for the implementation thereof are described in a preferred exemplary embodiment in the following by reference to drawings. In the drawings:

FIG. 1: shows the device for producing a driving force, in a frontal view having a cutaway side wall of the vessel (1);

FIG. 2: shows the device according to FIG. 1, including a cutaway wall of the bell-shaped insert (2) having a rotor (8) disposed therein, and having a hollow body (3), which is cutaway in sections;

FIG. 3: shows the device according to FIG. 2, although without the side wall or upper wall/cover of the vessel (1), at the intersection A-A of FIG. 2;

FIG. 4: shows the device according to FIG. 3, in a perspective view from above;

FIG. 5: shows the device according to FIG. 1, without the side wall and base of the vessel (1), at the intersection A-A according to FIG. 2, with the turbine wheel (12) and the bearing bushing (11) thereof, in a perspective view from the lower front;

FIG. 6: shows, as details of the device, the rotor (8) and a shaft (7), and the turbine wheel (12) with a shaft (13) and a schematically depicted, driven wheel (24);

FIG. 7: shows, as details of the device, the device depicted in FIG. 6 and, additionally, two ascending pipes (10) and nozzles (22);

FIG. 8: shows a longitudinal section through the device at the center point of the upper and lower base;

FIG. 9: shows, as a further detail of the device, the rotor (8), without the shaft (7), having channels (6) shown in a phantom view;

FIG. 10: shows a schematic representation of the method in the form of a longitudinal section according to FIG. 8;

FIG. 11: shows, as a detail, a ring (25), which is fixedly mounted on the inner wall of the insert (2) and which has a mesh plate (26), and the rotor (8) running therein, without the shaft (7), in a perspective view from the lower front;

FIG. 12: shows the ring (25) with the mesh plate (26) and the rotor (8) according to FIG. 11, in a perspective view from above;

FIG. 13: shows, as details, the ring (25) with the mesh plate (26), placed against the inner wall of the insert (2), and the rotor (8), with the cutaway insert (2) and the cutaway ring (25) with the mesh plate (26), in a perspective view from above.

The subject matter of the invention is primarily the method, which produces a continuous water circuit and, therefore, kinetic energy within the machine with the introduction of two different forms of energy, namely a pressure increase and power in the form of a rotating shaft, and the device for implementing and utilizing this method for the purpose of utilizing the permanently available energy form and the conversion thereof into mechanical energy in the form of a rotating shaft.

According to the method, circulation of the liquid medium is induced in a vessel, which is closed on all sides and is partially filled with liquid medium and partially with gaseous medium, preferably with water and air, thereby producing kinetic energy. The gaseous medium is located in an insert, which is open on the underside and is preferably bell-shaped, within a hollow body, which is disposed at least partially above the insert and is connected therewith in a fixed and sealed manner, and, before the system is started up, said gaseous medium is also disposed in one or more ascending pipes, which extend at least partially, preferably completely, within the enclosed vessel, although outside the insert and preferably vertically, and which are open at the lower ends thereof and are connected, via the upper ends thereof, to the hollow body. In a preferred embodiment, the hollow body is located completely within the enclosed vessel, although this is not absolutely necessary. When the vessel is filled from below, the liquid medium enters the bell-shaped insert and the ascending pipes, and rises in this insert and in the ascending pipes until pressure equilibrium is reached. The vessel is then closed in a pressure-sealed manner and, therefore, the potential energy of the two media increases further within the vessel by being subjected to compressed air. In the gaseous medium, a specially designed, horizontally disposed rotor having a vertical axis of rotation is set into rotational motion by means of a motor. In the previously set, operable state of the system, the level of the liquid medium within the bell-shaped insert is located between the lower end thereof and below the underside of the rotating rotor. This rotor, in the form of a disk having a specially-shaped jacket surface, produces a negative pressure thereon relative to the pressure of the enclosed gas. This negative pressure induces, via tubular, open channels within the rotor disk, a corresponding negative pressure in the hollow body. As a result of the negative pressure in the hollow body, in combination with the gas pressure in the insert, the liquid medium is conveyed out of the vessel, through the ascending pipe(s), and into the hollow body, and kinetic energy is produced and made available in the form of the liquid medium entering the hollow body.

As a result of the delivery process, a liquid level having a low height forms within the hollow body, whereupon the gas pressure in the hollow body increases relative to the negative pressure produced by the rotor, while remaining lower than the gas pressure in the insert. The liquid medium that flowed into the hollow body is suctioned out of same via channels within the rotor disk due to the effective differences in pressure and returns to the liquid level in the insert, and therefore, during rotation of the rotor, a circuit forms that continuously provides kinetic energy.

The gas pressure that is given off and the rotational speed of the rotor in the insert determine the volumetric flow rate and conveyance speed of the liquid medium and, therefore, the kinetic energy that is produced. The ratio between the volumetric flow rate and the speed can also be controlled via nozzles at the outlet of the ascending pipes.

The kinetic energy of the liquid medium that is produced and made available in this form can generate drive energy by means of suitable devices, such as a constant-pressure turbine, the turbine wheel of which is set into motion by the stream of the impacting water or any other liquid medium, wherein this drive energy is intended for stationary or mobile use.

The device according to the invention comprises, in the exemplary embodiment shown, a vessel (1), which is closed on all sides and has the form of a barrel, a sphere, a cube or a cuboid, or another form, wherein an insert (2), which is open on the underside thereof and is preferably bell-shaped, is inserted in this container (1). A preferably spherical hollow body (3) is disposed on the top side of the insert (2). In a preferred embodiment, the hollow body (3) extends, by a portion of the height thereof, into the insert (2), wherein sealing with respect to the vessel (1) occurs in the region of the connection of the insert (2) and the hollow body (3). The hollow body (3) need not necessarily extend into the insert (2), however.

The hollow body (3) has, at the lower end thereof, an outlet opening (4) and an attachment (5). In the exemplary embodiment shown, the insert (2) and the hollow body (3) are disposed entirely within the vessel (1) and so, in this case, the top side of the vessel (1) is formed in accordance with the above-mentioned geometric shape. Within the scope of the invention, it is possible, however, for the top side of the vessel (1) to be formed by an annular cover, the upper part of the insert (2), and the part of the hollow body (3) protruding upwardly out of this insert. It is also possible, according to the invention, for the top side to be formed by an annular cover and the upper part of the hollow body (3).

A rotor (8) is fastened to a vertical shaft (7), which is disposed within the vessel (1) in a shaft housing so as to be rotatable and pressure-sealed with respect to gaseous and liquid media and which is driven from outside the vessel (1) by a motor, wherein this rotor is disposed within the insert (2) with a certain separation from the inner wall of the insert (2). The rotor (8) has an attachment (23), by means of which this rotor is operatively connected to the outlet opening (4) of the hollow body (3), in that the attachment (23) of the rotor (8) extends, in a rotatable and sealed manner, although without a fixed connection, into the outlet opening (4) of the hollow body (3) and extends over this outlet opening over a portion of the height thereof.

The rotor (8) is designed as a cylindrical disk and is preferably flat or has a jacket surface bending slightly downward at the edge. The outer jacket surface of this disk comprises one or more wing profile units (16), similar to the DE patent 10 2005 049 938. The wing profile units (16), which are disposed on the circumference of the jacket surface of the rotor (8) with preferably periodic spacing, each comprise a convex raised area (17) followed, in the direction of rotation of the rotor (8), by a flat runout region (18). The outlet openings (21) of the rotor (8) are disposed in this runout region (18) at the point of the minimally effective static pressure in the circumferential direction of the rotor jacket surface in the case of rotation at rated operative speed.

The attachment (23) of the rotor (8) comprises one or more, preferably three tubular, open channels (6), which extend from the upper end of the attachment (23) through the inner region (20) of the rotor (8) to the outer jacket surface thereof and lead into the outlet openings (21). As a result, a liquid or gaseous medium conveyed out of the hollow body (3) and through the outlet opening (4) can enter the channels (6) of the rotor (8) and, via the channels (6) and the outlet openings (21), can enter the insert (2).

Furthermore, one or more—two, in the exemplary embodiment shown—ascending pipes (10) can be installed within the vessel (1), but outside of the insert (2), wherein these ascending pipes are open at the lower end thereof, preferably extend vertically, and extend downward at least to the lower edge of the insert (2). These ascending pipes are inserted, via the upper ends thereof, into the hollow body (3) in a sealed manner via bends above the insert (2). In an advantageous embodiment, the ascending pipes (10) comprise, at the ends thereof within the hollow body (3), as shown in the figures, horizontally extending nozzles (22), which can be controlled by means of inner nozzle needles.

In an advantageous embodiment, although this is not absolutely necessary, a fixed ring (25) is disposed on the inner wall of the insert (2) opposite the jacket surface of the rotor (8), wherein this ring supports a mesh sheet (26), which is separated slightly from the inner wall, and on which the water emerging from the outlet openings (21) of the rotor (8) appears. By virtue of a suitable selection of the separation from the convex raised areas (17) of the wing profile units (16), the mesh sheet (26) enhances the generation of the negative pressure and makes it possible to divert the water emerging from the outlet openings (21) away from the rotor and toward the inner wall of the insert (2), while minimizing the frictional loss. The water then flows downward along the inner wall of the insert (2) to the level of the liquid.

In the case of another advantageous embodiment, although this is not absolutely necessary, cover plates (27) are located on the top side and on the underside of the jacket surface of the rotor (8) in the region of the wing profile units (16), wherein these cover plates extend radially outwardly beyond the rotor (8) and extend to the vicinity of the inner wall of the insert (2) and, after installation of a ring (25) having a mesh plate (26), extend over these without having contact therewith.

The rotor (8) is set into rotational motion via the shaft (7), either by means of a motor (9) disposed outside of the vessel (1), wherein the shaft (7) extends, in a sealed manner, through the base of the vessel (1), or the shaft (7) is a component of an encapsulated electric motor disposed within the vessel (1).

Furthermore, a feed pipe (14) for compressed air is provided, which extends from the outside of the vessel (1) into the insert (2) and opens into same above the lower limit thereof, preferably at approximately half the height between the underside of the rotor (8) and the lower edge of the insert (2).

Finally, a closable opening (15) for filling a liquid medium is provided in the upper wall/cover of the vessel (1).

The kinetic energy of a liquid medium made available by means of the above-described device can be used to produce drive energy in that, as shown in the exemplary embodiment depicted, a turbine wheel (12) of a constant-pressure turbine having vanes (19) disposed thereon is installed, on a vertical shaft (13), within the hollow body (3) at the level of the entry of the ascending pipes (10). The turbine wheel (12) is supported in a bushing (11) located underneath. The nozzles (22) are directed toward the vane inner sides of the turbine wheel (12), and the vanes (19) verge on the inner wall of the hollow body (3) without having contact therewith. The vertical shaft (13) of the turbine wheel (12) extends upwardly and extends through the wall of the hollow body (3) and the upper wall (the cover) of the vessel (1) for connection to devices and implements (24) to be driven, in particular generators, machines, or vehicles. The shaft (13) is supported in the vessel (1) so as to be sealed with respect to the gaseous medium in the hollow body (3) and the liquid medium in the vessel (1).

In order to implement the method and initiate operation of the device, an incompressible, liquid medium, preferably water, is filled, in a normal ambient atmosphere, into the vessel (1) through the opening (15) thereof, until this liquid medium reaches the uppermost point of the vessel (1). Thereby, the liquid medium also enters the bell-shaped insert (2) and the ascending pipes (10) from the lower openings thereof, until the air that is present therein and in the hollow body (3) connected thereto and that is enclosed by the incoming liquid medium is compressed to the extent that pressure equilibrium sets in. The opening (15) of the vessel (1) is then closed.

Compressed air from outside the vessel (1) is then introduced via the feed pipe (14) into the insert (2), whereby the pressure in the entire vessel (1) is increased until the desired operating state is reached. In this state of increased potential energy of the enclosed media, the rotor (8) is set into rotation via the shaft (7) by means of the motor (9), in fact, in the direction of rotation (to the left, as indicated in the exemplary embodiment shown in the drawings), such that, according to DE patent 10 2005 049 938, a negative-pressure effect sets in at the wing profile units (16) at the end of the convex raised areas (17) thereof, in the sloping, elongate runout regions (18) thereof. The magnitude of the negative pressure depends on the selected rotational speed of the rotor and the gas pressure within the insert (2). The gas pressure and the rotational speed of the rotor (8) can be changed at any time during operation in order to change the operating state.

The negative pressure in the runout region (18) of the wing profile unit (16) advances through the channels (6) in the hollow body (3) and, from there, into the ascending pipes (10). The negative pressure, which then acts in the hollow body (3), and the gas pressure, which exists simultaneously in the insert (2), thereby cause the water or any other liquid medium to flow out of the vessel (1) and the insert (2) via the ascending pipes (10) and the nozzles (22) into the hollow body (3) as a stream of high kinetic energy.

Likewise, as a result of the negative pressure induced by the running rotor (8) at the outlet openings (21) thereof and the gas pressure acting within the hollow body (3), the water or any other liquid medium flows out of the hollow body (3) through the channels (6) of the rotor (8) and through the outlet openings (21) in the runout region (18) of the wing profile units (16) into the insert (2) to the level of the liquid. During operation, the level of the liquid is always above the lower edge of the insert (2).

In the sense of the invention, the hollow body (3) can have a shape other than the spherical shape shown in the exemplary embodiment, such as the shape of cube, a cuboid, a barrel, or any other form.

By means of the above-described method and the device for the implementation thereof, mechanical energy is introduced into the system via the rotational motion of the rotor (8), and the potential energy of the media located in the system is increased by means of an external application of pressure. The negative pressure that therefore acts on the wing profile units (16) along the rotor jacket surface produces a continuous circulation of water or another liquid medium and, therefore, produces constantly available kinetic energy. As described by reference to the exemplary embodiment shown, this energy form can be used to produce power in a manner that is constant with respect to time, and therefore, in contrast to the usual conditions for use of the technically known turbo engines, that is independent of geographical conditions or natural circumstances.

In the state of equilibrium of the system, the kinetic energy that is produced is greater than the sum of the power to be introduced into the system in the form of mechanical energy from the rotational motion of the drive shaft (7) having a constant rotational speed and the one-time increase in potential energy of the enclosed media by an external application of pressure via the feed pipe (14). This is achieved according to a technically novel principle, in that, in the case of the method according to the invention and the device for the implementation thereof, the transfer of energy from the rotor (8) to the incompressible medium—mechanical to kinetic—does not take place directly by means of an impeller having a conventional configuration, but rather indirectly via the generation of a relative negative pressure in the compressible medium. In order to increase the efficiency of this process, the pressure of the compressible medium is increased in advance relative to the ambient state. The generation of the effective negative pressure takes place on the jacket surface of the rotor (8), which is designed having the above-described profile shape, which is based on the mode of operation of DE patent 10 2005 049 938. The rotor (8) of the method according to the invention, however, runs primarily in a compressible medium having a very low density and can therefore be driven against a slight frictional resistance.

The requirement of the system for liquid medium, preferably water, is limited to the one-time filling procedure before the initial start-up. Likewise, the supply of external compressed air is required only the first time the working internal pressure is set. Throughout the operation of the system, power must be supplied only to drive the shaft (7), and no environmentally hazardous emissions are produced. In order to interrupt or halt the operation of the system, it is merely necessary to shut off the drive power to the shaft (7). The system then automatically returns to the starting state thereof.

The invention claimed is:

1. A device for generating a continuous driving force by providing kinetic energy of a liquid medium generated by bringing about differences in pressure in a closed system which is filled with the liquid medium and a gaseous medium, comprising:

a vessel which is closed on all sides and having a closeable opening for filling the vessel with the liquid medium;

an insert inserted into the vessel, the insert being open on an underside thereof;

a spherical hollow body having an outlet opening and an attachment, said spherical hollow body being located on a top side of said insert, said hollow body being disposed entirely or partially within the vessel and extending into the insert by a portion of a height thereof, said hollow body being pressure-sealed both with respect to the vessel and with respect to the insert, except for the outlet opening, a rotor disposed within the insert and having a separation from an inner wall of the insert, the rotor being formed as a cylindrical disk on a vertical shaft in a shaft housing so as to be rotatable and pressure-sealed, an attachment, via which the rotor extends, in a rotatable and sealed manner, without a fixed connection, into the outlet opening of the hollow body via the attachment of the hollow body, said rotor extending over said outlet opening over a portion of the height thereof, wherein the rotor including the attachment comprises one or more tubular channels, which are open at ends thereof and extend from an upper end of the attachment of the rotor through an inner region of the rotor to an outer circumference thereof and terminate in outlet openings of the rotor, wherein a jacket surface of the rotor is provided with one or multiple wing profile units which are disposed with periodic spacing from each other and each consist, in a direction of rotation of the rotor, of a convex raised area followed by a flat runout region having the outlet openings of the rotor, a motor configured for driving the rotor;

one or more ascending pipes mounted in the vessel outside the insert, said pipes being open at lower ends thereof and extending vertically downwardly at least to a lower edge of the insert and being inserted, via upper ends thereof, into the hollow body in a sealed manner via bends above the insert and terminating horizontally within the, hollow body, and a feed pipe for compressed air being routed from outside the vessel into the insert and leading into the insert, above an upper edge thereof.

2. The device according to claim 1, wherein the closable opening of the vessel is closed by an annular cover, an upper part of the insert, and the part of the hollow body protruding upwardly out of the insert.

3. The device according to claim 1, wherein the closable opening of the vessel is formed by an annular cover and the upper part of the hollow body.

4. The device according to claim 1, wherein the rotor is designed as a flat cylindrical disk or has a jacket surface bending slightly downward at the edge.

5. The device according to claim 1, further comprising a ring fixedly disposed on the inner wall of the insert and opposite the jacket surface of the rotor, said ring supporting a mesh sheet which is separated from the inner wall and on which water emerging from the outlet openings of the rotor is retained.

6. The device according to claim 1, wherein the wing profile units comprise cover plates on a top side and on an underside of the rotor, said cover plates protruding radially outwardly and extending close to the inner wall of the insert and, when a ring having a mesh sheet is mounted thereon, extending over the ring and mesh sheet without having contact therewith.

7. The device according to claim 1, wherein the ascending pipes comprise, on the upper ends thereof, nozzles configured to be controlled in the hollow body.

8. The device according to claim 1, wherein the motor is an encapsulated electric motor disposed within the vessel, and wherein the shaft of the rotor forms a component of the encapsulated electric motor.

9. The device according to claim 7, further comprising a constant-pressure turbine having a turbine wheel with vanes disposed thereon, on a vertical shaft, the turbine being disposed within the hollow body at a level of entry of the ascending pipes, and being supported in a bushing located underneath the turbine wheel, wherein the vanes verge on the inner wall of the hollow body without having contact therewith, wherein the nozzles on the ends of the ascending pipes are directed toward inner sides of the vanes, and wherein the shaft of the turbine extends through the wall of the hollow body and the upper wall of the vessel so as to be sealed with respect to gaseous medium in the hollow body and liquid medium in the vessel and is configured for attachment to devices and implements to be driven.

10. A method for operating a device for producing a continuous driving force by providing kinetic energy of a liquid medium generated by bringing about differences in pressure in a closed system which is filled with a liquid medium and a gaseous medium in a device according to claim 1, comprising the following steps:

inducing a circulation of the liquid medium by filling the vessel with the liquid medium, and thereby enclosing the gaseous medium with the liquid medium in the insert, in the hollow body and the ascending pipes, the gaseous medium being present before the filling and being under atmospheric pressure, and rising therein until pressure equilibrium is reached, increasing the potential energy of the gaseous and liquid medium via external application of pressure, rotating the rotor within the insert in the gaseous medium by a motor, such that a negative pressure relative to the pressure of the enclosed gas is produced at the surface of the rotor jacket and induces a corresponding negative pressure in the hollow body, wherein, by means of the negative pressure in the hollow body, in combination with the gas pressure in the insert, the liquid medium is conveyed through the ascending pipes, out of the vessel into the hollow body, and kinetic energy is generated and made available, and, suctioning the liquid medium that has flowed into the hollow body out of the hollow body and returning to the liquid level in the insert due to an increase in gas pressure in the hollow body with respect to the negative pressure generated by the rotor, brought about by a liquid level having a lower height formed within the hollow body in the conveying process, wherein the gas pressure in the hollow body remains lower than gas pressure in the insert.

11. The method according to claim 10, wherein the amount of kinetic energy generated is determined by volumetric flow rate and conveyance speed of the liquid medium, which depend on the external application of pressure and the rotational speed of the rotor in the insert.

12. The method according to claim 11, wherein a ratio of the volumetric flow rate and conveyance speed of the liquid medium is additionally controlled via nozzles at the outlet of the ascending pipes in the hollow body.

* * * * *